US005106418A

United States Patent [19]

Szépföldi et al.

[11] Patent Number: 5,106,418

Date of Patent: Apr. 21, 1992

[54] PROCESS FOR PREPARING IMPROVED BINDING MATERIAL SYSTEM, ITS USE FOR COAL-DUST-FREE REFINING, FOR MOULDING OF BENTONITE BINDINGS AND FOR MOULD-CORE-FORMATION

[75] Inventors: Gyula Szépföldi; István Halász; Kálmán Kovaliczky; Károly Gedey, all of Budapest, Hungary

[73] Assignee: Hungaroben Kft., Budapest, Hungary

[21] Appl. No.: 364,206

[22] Filed: Jun. 9, 1989

[30] Foreign Application Priority Data

Sep. 30, 1988 [HU] Hungary ..... 5093/88

[51] Int. Cl.[5] ..... B28B 7/34

[52] U.S. Cl. ..... 106/38.51; 106/38.7; 106/DIG. 4

[58] Field of Search ..... 106/38.51, 38.7, DIG. 4

[56] References Cited

U.S. PATENT DOCUMENTS

| | | | |
|---|---|---|---|
| 3,086,874 | 4/1963 | Wallace et al. | 106/38.51 |
| 3,095,310 | 6/1963 | Wallace et al. | 106/38.51 |
| 3,285,756 | 11/1966 | Moren | 106/38.51 |
| 3,535,131 | 10/1970 | Meier | 106/38.51 |

FOREIGN PATENT DOCUMENTS

| | | | |
|---|---|---|---|
| 755234 | 2/1971 | Belgium | 106/38.51 |

*Primary Examiner*—Mark L. Bell

*Attorney, Agent, or Firm*—Schweitzer Cornman & Gross

[57] ABSTRACT

The invention describes a bonding material for casting mold, which comprises from about 0.5 to about 20 mass % plant-derived lecithin, plant oil or a mixture of lecithin and plant oil, from about 0.1 to about 5.5 mass % starch, starch derivative, sodium carboxymethylcellulose or a mixture thereof, from about 0.3 to about 4.5 mass % of sodium carbonate, 0.05 to 1.25 mass % of a boron compound, and the balance to 100 % being bentonite.

6 Claims, No Drawings

PROCESS FOR PREPARING IMPROVED BINDING MATERIAL SYSTEM, ITS USE FOR COAL-DUST-FREE REFINING, FOR MOULDING OF BENTONITE BINDINGS AND FOR MOULD-CORE-FORMATION

FIELD OF THE INVENTION

The present invention relates to a process for preparing improved bonding material to be used for coal dust-free refining, for molding in bentonite-bonded molds and mold core formation.

BACKGROUND OF THE INVENTION

Molding mixtures containing quartz sand, clay, bentonite, coal dust and water are widely known in the preparation of casting molds. Coal dust is used in bentonite-containing molding mixtures as glossy carbon carrier for improving the surface quality of the casting, and also as an additive for reducing the burning on of the sand onto the cast object.

After the casting in bentonite containing molds containing coal dust additive and of cores new sand, it is known to add bentonite, coal dust and water to the removed, then in continuous recirculation reused sand mixture for supplementing the burned out coal dust, and the amount of the degraded bentonite. This is done by separate measuring and adding methods to refine the molding sand.

In addition to the aforementioned known advantages of using coal dust in casting, there are also a number of disadvantageous physical chemical and colloidal effects.

During our investigations we have found that the desirable solidity of sand mixtures that are reused after casting in circulation the bentonite containing molds and cores containing coal dust additive, can be readjusted only by using much greater amounts of bentonite than heretofore.

The reason for this is that due to unfavorable chemical reaction, the Na-cation exchange necessary in the coal dust additive containing molding sand for the formation of the maximal working capacity of the bentonite added while refining, can be formed only to a very small degree. This is so, on the one hand because of the time dependence of the reaction rate of the ion exchange, on the other hand because of the lack of suitable pH of the reused molding sand and of the necessary Na-ion-concentration.

We have found that the aforementioned essential and important preconditions cannot be endures by the traditional refining method due to the continuous addition of the coal dust additive, and due to its physical and especially dangerous chemical characteristics, that are so different from those of bentonite.

Coaldust cannot be suitably homogenized during refining, during the short mechanical stirring either by the added bentonite or by the reused molding sand due to the greater specific gravity and hydrophobic characteristics of the bentonite. In the casing mold and in cores prepared from molding sands the desired constant strength of material cannot be obtained.

The main problem is probably due to the especially disadvantageous physical, chemical and colloidal properties of the especially disadvantageous combustion by-products of the coal dust to bentonite.

Due to the heat in casting, not only the advantageous glossy carbon will be formed from the coal dust but at the same time fused slag and powdered ash are also formed in very significant amounts, of about 18–35 mass % as solid combustion by-products.

Their presence in the casting molds with bentonite binding and in the cores is very disadvantageous, because the fused slag contains substantial amounts of refractory granule attached to the surface of the cast object by which the required time and energy involved in cleaning the surface of the cast object is significantly increased.

The presence of powdered sand is also disadvantageous because the molding sand becomes continuously and quickly turned to dust. Thus, its ability to be formed deteriorates, its water requirement increases, along with its permeability and technological strength, increasing the amount of casting rejects.

The ashes of coal dust are disadvantageous not only for their mere presence, but mainly they concentrate strongly acidic compounds therein, which dissolve and dissociate well in the water of the bentonite-containing molding sand. Contrary to the alkaline chemical effect necessary for the advantageous Na-cation-exchange the pH of the electrolyte thus becomes reduced in the direction of the especially disadvantageous acidic pH range. The continuously increasing hydrogen ion concentration results in an especially unfavorable cation exchange to bentonite, whereby the swellability and working capacity will significantly be reduced or completely ceases.

The high sulfur content of the coal dust also results in some of the fundamental problems. As a result of the heat during casting, not only the advantageous glossy carbon forming hydrocarbon develop from the coal dust additive of the bentonite-containing molds and cores, but also significant amounts of $SO_2$ gas are formed from the sulfur content. A large part of the $SO_2$ is absorbed in the molds and cores themselves, while another part of the $SO_2$ evaporates into the air space of the casting house and causes various labor hygienic and environmental protection problems, as well as acts as a corrosive.

The absorption of $SO_2$ gas is very disadvantageous in the bentonite-containing casting molds and cores because under the conditions after the different oxidation reactions sulfurous acid or sulfuric acid is formed, which dissolve well in the water that is present, they dissociate well and ensure thereby the continuous formation of acidic pH within the casting molds and cores. In other words they increase the unfavorable hydrogen ion concentration and thus force a disadvantageous cation exchange to the sill bindable bentonite, as they transform it to hydrogen bentonite.

Thus they significantly decrease or completely eliminate the advantageous swellability and working capacity of bentonite, resulting in a reduction of the desired strength of casting molds and cores.

DESCRIPTION OF THE INVENTION

An objective of the invention is to eliminate the aforementioned disadvantageous characteristics of coal dust containing large amounts of elementary sulfur, when used for molding employing bentonite binding according to the traditional process. By the elimination of coal dust additive, and its replacement by the improved binding material system of the present invention the refining method can be carried out more simply, precisely and effectively, the amount of bentonite necessary for readjusting the suitable strength of the molding sand when continuously, reused in recirculation can be reduced by 25–40%; thereby resulting in a significant reduction in the delivery, storage and moving of materials, reduction of energy and worktime requirements and of casting rejects, an improvement in productivity, a facilitation of making the castings sand free and thus an improvement of the surface quality of the cast object is achievable.

Another objective of the invention is to increase the level of labor hygiene and environmental protection and provide better protection against corrosion. The present invention relates to an improved binder composition for casting molds and cores from about 0.5 to about 20 mass % of plant-derived lecithine, or plant oil, or the mixture thereof in any desired ratio; from about 0.1 to about 5.5 mass % of starch, starch derivative of carboxymethylcellulose-sodium or the mixture thereof in any desired ratio; from about 0.3 to about 4.5 mass % of sodium carbonate; from about 0.05 to about 1.25 mass % of a boron compound; and bentonite to 100 mass %.

The invention also relates to a process for the use of the improved casting binder material system according to the process in the coal dust free refining of the bentonite-containing molding sand continuously reused in recirculation by further processing it by a manual or mechanical method in the preparation of casting molds and of cores, from which $SO_2$ gas will not be formed during molding and enabling a substantial reduction in the use of bentonite, improving the labor hygienic and environmental conditions of casting house, and provide improved protection against corrosion.

The process according to the invention enables a reduction of materials, energy and worktime, and the refining method can be carried out in a simpler, more precise and more effective manner. The addition of coal dust can be eliminated and the amount of bentonite necessary for refining can significantly be reduced, by about 25–40 mass %.

Coaldust containing large amounts of sulfur is not used in accordance with the invention as carbon carrier, additional bentonite is not required, instead of these the binding material system of the process of the present invention can be homogenized more quickly and more perfectly with the molding sand.

In accordance with the present invention sulfur-free carbonaceous compounds are employed which are compatible with the bindable NA-bentonite in every respect, and their combustion by-products do no cause the formation of hydrogen bentonite. They enable attainment of the alkaline pH required for NA-bentonite formation and also of the suitable NA-ion concentration. They also make possible the use of the perfected casting binding material system of the present invention as stable bentonite suspension for the coal dust free refining.

The present invention also relates to a process for preparing an improved binder by preparing a composition of from about 0.05 to about 20% mass of plant-derived lectine or a plant oil or the mixture of both in any desired ratio; from about 0.1 to about 5.5 mass % of starch or starch derivative or carboxymethylcellulose sodium or the mixture thereof in any desired ratio; from about 0.3 to about 4.5 mass % of Na-carbonate; from about 0.5 to about 1.25 mass % of boron compound, and bentonite to 100 mass %.

The invention thus involves the use of the foregoing improved binder in the refining in recirculation continuously reused bentonite-containing molding sand without employing any coal dust additive, and the processing manually or by mechanical means with the improved bentonite binder, into improved casting molds and cores in a manner known per se from the aforementioned organic carbonaceous materials from which no $SO_2$ gas will be liberated during exposure to the heat of casting.

The improved binder for casting molds and cores of the present invention is further exemplified in the following six examples.

EXAMPLE 1

| | |
|---|---|
| 92.50 kg | bentonite |
| 1.75 kg | soy oil |
| 1.75 kg | soy lecithine |
| 2.00 kg | starch |
| 1.50 kg | $Na_2CO_3$ |
| 0.50 kg | $B_2O_3$ |
| 100.00 kg | |

EXAMPLE 2

| | |
|---|---|
| 92.50 kg | bentonite |
| 2.50 kg | soy oil |
| 2.50 kg | soy lecithine |
| 1.50 kg | $Na_2CO_3$ |
| 0.50 kg | $B_2O_3$ |
| 0.50 kg | carboxymethylcellulose-Na |
| 100.00 kg | |

EXAMPLE 3

| | |
|---|---|
| 91.00 kg | bentonite |
| 3.50 kg | sunflower oil |
| 3.50 kg | sunflower lecithine |
| 1.50 kg | $Na_2CO_3$ |
| 0.50 kg | $B_2O_3$ |
| 100.00 kg | |

EXAMPLE 4

| | |
|---|---|
| 89.30 kg | bentonite |
| 4.00 kg | sunflower oil |
| 4.00 kg | sunflower lecithine |
| 2.00 kg | $Na_2CO_3$ |
| 0.70 kg | $B_2O_3$ |
| 100.00 kg | |

EXAMPLE 5

| | |
|---|---|
| 93.20 kg | bentonite |
| 1.25 kg | soy oil |
| 1.25 kg | soy lecithine |
| 1.75 kg | starch |
| 1.50 kg | $Na_2CO_3$ |
| 0.50 kg | borax |
| 0.55 kg | carboxymethylcellulose-Na |
| 100.00 kg | |

EXAMPLE 6

| | |
|---|---|
| 88.00 kg | bentonite |

-continued

| | |
|---|---|
| 5.00 kg | sunflower oil |
| 5.00 kg | sunflower lecithine |
| 1.50 kg | $Na_2CO_3$ |
| 0.50 kg | $B_2O_3$ |
| 100.00 kg | |

The binders of the above compositions can be stored after their homogenization in silos, plastic or metal containers or in sacks until their use.

The use of the improved binder is further illustrated in the following five examples.

CONTROL A

After casting, the cast object is removed, the sand is reused by recirculation and is replenished and reused of bentonite binding containing coal dust with coal dust containing bentonite binder as follows:

| | |
|---|---|
| 650 kg | reused sand |
| 150 kg | slope sand of Bicske, Hungary |
| 24 kg | OA-bentonite |
| 24 kg | coaldust |
| 843 kg | (humidity content = 4.0–5.5%) |

The so prepared forming sand mixture containing the coal dust additive was examined and the following properties were found.

crushing strength = 9.6–10.4 N/cm$^2$
shearing strength = 0.9–1.4 N/cm$^2$
gas permeability = 75–95 units
humidity content = 5.6%

EXAMPLE 7

In contrast to control A the binder composition of Example 4 was employed according to the process of the present invention:

| | |
|---|---|
| 650 kg | reused sand |
| 150 kg | slope sand of Bicske, Hungary |
| 15 kg | the binder composition of Example 4 |
| 815 kg | (humidity content = 4.5%) |

In contrast with Control A, the molding sand refined by this Example 7 without any coal dust additive was examined and the following properties were found:

crushing strength = 13.4–14.6 N/cm$^2$
shearing strength = 2.3–2.6 N/cm$^2$
gas permeability = 95–110 units
humidity content = 4.3%

These values compare most favorably with the results of Control A.

CONTROL B

Continuously reused molding sand being in recirculation is refined by coal dust according to the traditional process by preparing the following casting mold composition:

| | |
|---|---|
| 540 kg | reused sand |
| 60 kg | sand K4 |
| 18 kg | OA-bentonite |
| 9 kg | coaldust |
| 627 kg | (water content = 4.5–5.5%) |

The above composition of Control B is examined with the result:

crushing strength = 10–12.5 N/cm$^2$
shearing strength = 1.8–2.2 N/cm$^2$
gas permeability = 85–110 units
humidity content = 5.6%

EXAMPLE 8

The coal dust free binder composition of Example 3, according to the process of the invention was prepared from:

| | |
|---|---|
| 540 kg | reused sand |
| 60 kg | sand K4 |
| 10 kg | binder composition of Example 3 |
| 610 kg | (water content = 5%) |

The test results of the molding sand of the above composition provided:

crushing strength = 13.5–15.5 N/cm$^2$
shearing strength = 2.5–3.5 N/cm$^2$
gas permeability = 110–130 units
humidity content = 4.8%

Also a most significant improvement over Control B.

EXAMPLE 9

The stable aqueous suspension of the binder composition of Example 3 was compounded;

| | |
|---|---|
| 540 kg | reused sand |
| 60 kg | sand K4 |
| 7 kg | the binder composition Example 3 suspended in 14 liter of water. |
| 607 kg | |

The testing of the molding sand of the above composition provided the following properties crushing strength = 14.6–16.5 N/cm$^2$
shearing strength = 2.8–3.9 N/cm$^2$
gas permeability = 115–125 units
humidity content = 4.5%

CONTROL C

Continuously reused molding sand is recirculated is refined traditionally with coal dust as follows:

| | |
|---|---|
| 630 kg | reused sand |
| 210 kg | sand K4 |
| 25 kg | OA-bentonite |
| 30 kg | coaldust |
| 895 kg | (water content = 5.5–6%) |

Testing resulted in obtaining the following properties:

crushing strength = 9.1–9.6 N/cm$^2$
shearing strength = 2.4–2.5 N/cm$^2$
gas permeability = 70–80 units
humidity content = 5.1%

EXAMPLE 10

The coal dust-free binder composition of Example 4 was compounded with sand:

| | |
|---|---|
| 630 kg | reused sand |
| 210 kg | sand K4 |
| 15 kg | the binder composition of Example 4 |
| 855 kg | |

Testing of the molding sand of the above composition provided the following results.
crushing strength = 15.5–17.5 N/cm$^2$
shearing strength = 4.8–5.1 N/cm$^2$
gas permeability = 80–110 units
humidity content = 4.8%

CONTROL D

Molding is compounded as follows:

| | |
|---|---|
| 510 kg | reused sand |
| 90 kg | slope sand of Bicske, Hungary |
| 24 kg | OA-bentonite |
| 24 kg | coaldust |
| 648 kg | (water content = 4.5–5.8%) |

Testing yielded the following properties:
crushing strength = 10.5–12.5 N/cm$^2$
shearing strength = 2.0–2.5 N/cm$^2$
gas permeability = 85–95 units
humidity content = 5.7%

EXAMPLE 11

Casting sand was reused by compounding with the binder composition of Example 3:

| | |
|---|---|
| 510 kg | reused sand |
| 90 kg | pit-sand of Bicske |
| 16 kg | the binder composition of Example 3 |
| 616 kg | (water content = 4.5%) |

Testing of this molding sand provided the following results:
crushing strength = 13.5–17.5 N/cm$^2$
shearing strength = 4.5–5.5 N/cm$^2$
gas permeability = 105–115 units
humidity content = 4.2%

We claim:

1. Bonding material for casting mold, which comprises from about 0.5 to about 20 mass % a first material selected from the group consisting of plant-derived lecithin, plant oil or a mixture thereof from about 0.1 to about 5.5 mass % a second material selected from the group consisting of starch, starch derivative, sodium carboxymethylcellulose or mixtures thereof from about 0.3 to about 4.5 mass % of sodium carbonate; from about 0.05 to about 1.25 mass % of a boron compound, and the balance to 100% of the bonding material being bentonite.

2. The bonding material for casting mold of claim 1, wherein said plant-derived lecithin is derived from the group consisting of sunflower, soy or mixtures thereof, and said plant oil is selected from the group consisting of sunflower oil, sou oil or mixtures thereof.

3. The bonding material for casting mold of claim 1, wherein said where the second material is selected from the group consisting of wheat starch, corn starch, dextrine, sodium carboxymethylcellulose or mixtures thereof.

4. The bonding material for casting mold of claim 1, wherein said boron compound is selected from the group consisting of $B_2O_3$, borax or mixtures thereof.

5. A process for refining continuously recirculated sand free of coal dust in a process of casting in sand molds, which comprises mixing the recirculated mold-making sand with the binding material of claim 1, adjusting its humidity content to a value of from about 3.0 to about 5.8%, and forming the mixture into a casting mold and/or core for a casting mold.

6. The process of claim 5, wherein said bonding composition is added to the sand either as a dry powder, or as an aqueous suspension containing from about 30 to about 39 mass % solids.

* * * * *